US009139022B2

(12) United States Patent
Sasaki

(10) Patent No.: US 9,139,022 B2
(45) Date of Patent: Sep. 22, 2015

(54) RECORDING APPARATUS

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/483,006

(22) Filed: Sep. 10, 2014

(65) Prior Publication Data

US 2015/0077495 A1 Mar. 19, 2015

(30) Foreign Application Priority Data

Sep. 19, 2013 (JP) ..... 2013-193895

(51) Int. Cl.
*B41J 2/01* (2006.01)
*B41J 11/00* (2006.01)
*B41J 13/02* (2006.01)

(52) U.S. Cl.
CPC ..... *B41J 11/0015* (2013.01); *B41J 11/002* (2013.01); *B41J 13/02* (2013.01)

(58) Field of Classification Search
CPC ..... B41J 11/007; B41J 11/0085; B41J 11/06; B41J 11/0005; B41J 11/001; B41J 11/002; B41J 11/0015; B41J 2/01; B41J 29/377; B41M 7/0081
See application file for complete search history.

(56) References Cited

U.S. PATENT DOCUMENTS

2009/0066976 A1 3/2009 Uchida et al.

FOREIGN PATENT DOCUMENTS

| | | |
|---|---|---|
| JP | 06-246910 | 9/1994 |
| JP | 2004-160357 | 6/2004 |
| JP | 2007-320063 | 12/2007 |
| JP | 2010-039141 | 2/2010 |
| JP | 2013-107330 | 6/2013 |
| WO | 2007-129551 | 11/2007 |

*Primary Examiner* — Lisa M Solomon
(74) *Attorney, Agent, or Firm* — Workman Nydegger

(57) ABSTRACT

Provided is a recording apparatus that includes a setting portion in which a recording medium is set, a head portion which discharges ink onto the recording medium, a transporting roller portion which is provided at a portion between the setting portion and the head portion in a transporting path of the recording medium and transports the recording medium, a blower which blows air to a recording surface side of the recording medium transported by the transporting roller portion and to a portion between the transporting roller portion and the head portion, and an ion generator which is provided at a portion between the blower and the recording surface side of the recording medium, in the air blowing path of air blown by the blower.

5 Claims, 5 Drawing Sheets

RECORDING APPARATUS

BACKGROUND

1. Technical Field

The present invention relates to a recording apparatus.

2. Related Art

In recent years, a recording apparatus which includes a transporting roller portion for transporting a recording medium has been used. In some cases, a recording medium is charged by, for example, peeling electrification generated by the transporting roller portion for transporting the recording medium. Therefore, a recording apparatus in which an ionizer for neutralizing a charged recording medium is provided has been disclosed in, for example, JP-A-2013-107330.

However, in some cases, in the recording apparatus disclosed in JP-A-2013-107330, ions generated in the ionizer do not adequately reach the recording medium. As a result, in some cases, effects of the ions are insufficient. In addition, ink mist which floats in accordance with recording by a head portion adheres to an ion generator of the ionizer, and thus ion generation failure is caused. Therefore, in some cases, it is necessary to frequently replace the ion generator.

SUMMARY

An advantage of some aspects of the invention is to effectively prevent peeling electrification generated by a transporting roller portion for transporting a recording medium.

According to an aspect of the invention, there is provided a recording apparatus that includes a setting portion in which a recording medium is set, a head portion which discharges ink onto the recording medium, a transporting roller portion which is provided at a portion between the setting portion and the head portion in a transporting path of the recording medium and transports the recording medium, a blower which blows air to a recording surface side of the recording medium transported by the transporting roller portion and to a portion between the transporting roller portion and the head portion, and an ion generator which is provided at a portion between the blower and the recording surface side of the recording medium, in the air blowing path of air blown by the blower.

In this case, the blower which blows air to a portion between the transporting roller portion and the head portion and the ion generator which is provided at a portion between the blower and the recording surface side of the recording medium, in the air blowing path of air blown by the blower are provided. In other words, the blower causes the ions generated in the ion generator to effectively reach the recording medium. The ion generator is provided in the air blowing path, and thus ink mist which floats in accordance with recording by the head portion is sent, by an air flow blown by the blower, in a direction in which the ink mist moves away from the ion generator. Therefore, adhesion of the ink mist can be prevented. Thus, it is possible to effectively prevent peeling electrification generated by the transporting roller portion for transporting the recording medium.

In the recording apparatus, it is preferable that the air blowing path of air blown by the blower further extend, from a portion between the transporting roller portion and the head portion, in a transporting direction of the recording medium, along the recording surface of the recording medium.

In this case, the air blowing path further extend, from the portion between the transporting roller portion and the head portion, in the transporting direction of the recording medium, along the recording surface of the recording medium. In other words, the air blowing path is directed to an area of the recording medium, on which recording is performed by the head portion. Therefore, the ink is dried in such a manner that volatile components in the ink which is discharged onto the recording medium are volatilized by the air flow blown by the blower. In addition, the volatile components are sent in the direction in which the volatile components move away from the head portion, and thus condensation of the volatile components is prevented in the head portion.

The recording apparatus may further include a carriage which reciprocates in a direction intersecting with the transporting direction of the recording medium, in a state where the head portion is mounted on the carriage. In addition, it is preferable that the ion generator be mounted on the carriage.

In this case, the ion generator is mounted on the carriage. Therefore, a distance between the ion generator and the head portion is short and it is possible to neutralize the recording medium immediately before the head portion performs recording on the recording medium. As a result, it is possible to more effectively prevent peeling electrification generated by the transporting roller portion for transporting the recording medium.

The recording apparatus may further include an adjusting portion which adjusts a distance between the ion generator and the recording surface of the recording medium.

In this case, the adjusting portion for adjusting the distance between the ion generator and the recording surface of the recording medium is provided. Therefore, the ions generated in the ion generator can effectively reach the recording medium, in such a manner that the distance therebetween is adjusted. In addition, the ion generator is mounted on the carriage and the adjusting portion shortens the distance between the ion generator and the recording surface of the recording medium, for example, and thus the ion generator functions as a wall. Accordingly, it is possible to suppress the air flow blown to a lower portion of the head portion. Therefore, it is possible to prevent a landing position of the ink discharged through the head portion from being shifted by the influence of the air flow.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to examples of the invention will be described with reference to the accompanying drawings.

Example 1

Figure 1:
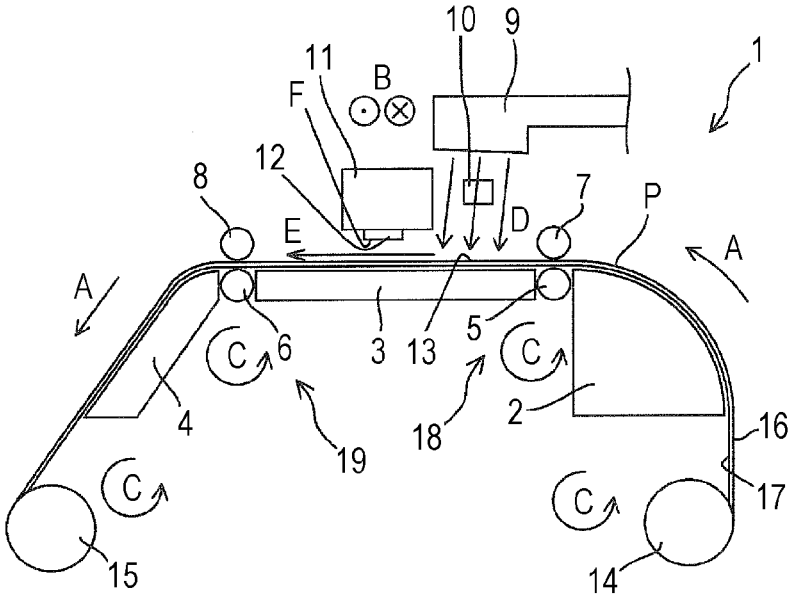
FIG. 1 is a schematic side view illustrating a recording apparatus according to Example 1 of the invention.
Figure 2:
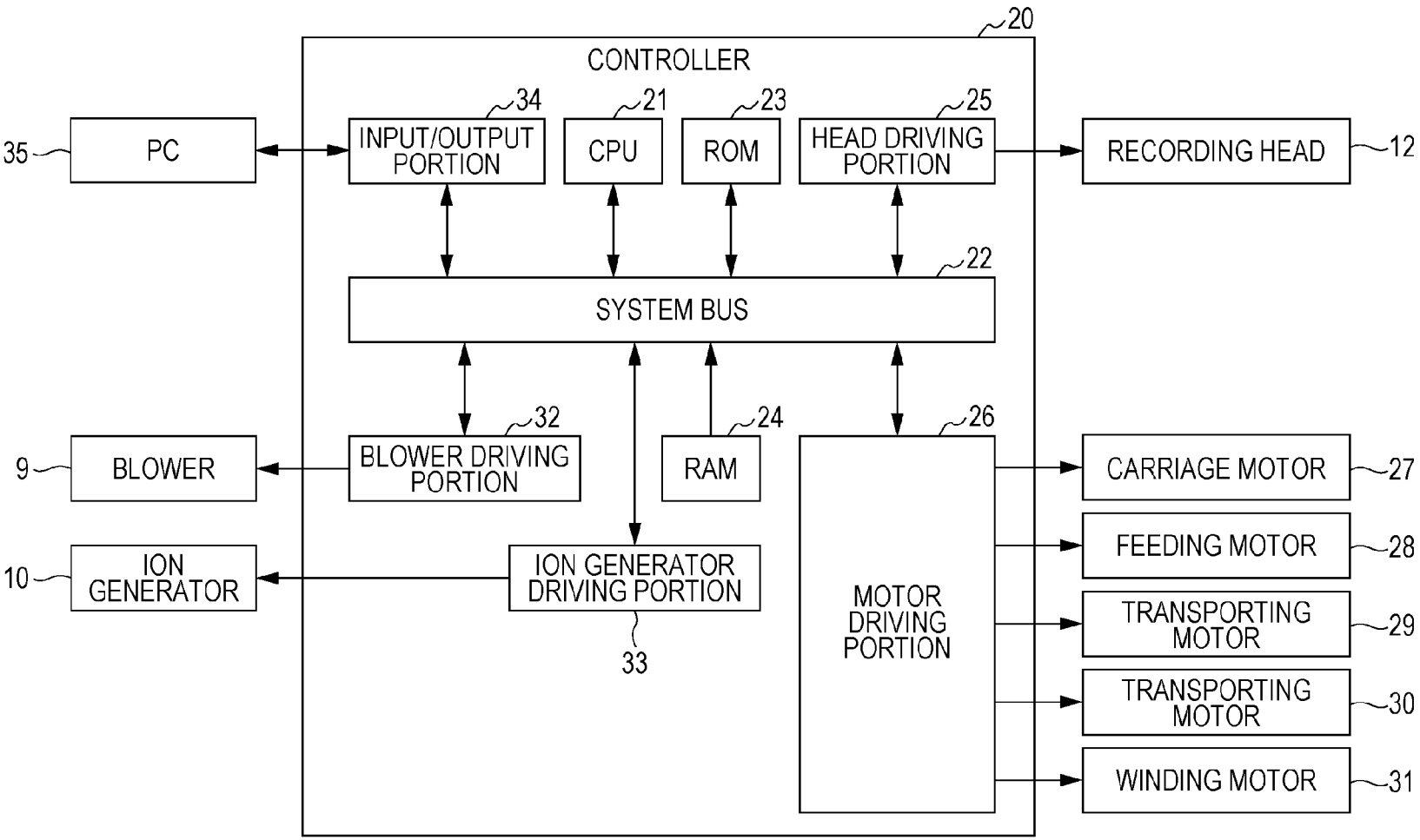
FIG. 2 is a block diagram of the recording apparatus according to the Example 1 of the invention.

FIGS. 1 and 2

FIG. 1 is a schematic side view illustrating a recording apparatus 1 according to Example 1 of the invention.

In the recording apparatus 1 of this example, a recording medium P is transported, in a transporting direction A, from a setting portion 14 of the recording medium P to a winding portion 15 of the recording medium P, through a platen 2, a platen 3, and a platen 4, which are supporting portions for the recording medium P. In other words, a path from the setting portion 14 to the winding portion 15 is a transporting path of the recording medium P in the recording apparatus 1. The platen 2, the platen 3, and the platen 4 are supporting portions for the recording medium P, which are provided on the transporting path. The setting portion 14 rotates in a rotation direction C so as to feed the recording medium P and the winding portion 15 rotates in the rotation direction C so as to wind the recording medium P therearound. In addition, heaters may be disposed in the platen 2, the platen 3, and the platen 4 and may heat the recording medium P from a back surface.

The recording apparatus 1 of this example can perform recording on a recording medium P in a rolled shape. However, the configuration is not limited thereto. The recording apparatus 1 of this example may perform recording on a recording medium P having a cut sheet shape.

In the recording apparatus 1 of this example, a transporting roller portion 18 is provided, in a transporting direction A of the recording medium P, in a portion between the platen 2 and the platen 3. The transporting roller portion 18 is a pair of transporting rollers constituted by a driving roller 5 which rotates in the rotation direction C and a driven roller 7. When the transporting roller portion 18 transports the recording medium P, the driven roller 7 comes into contact with a recording surface 16 of the recording medium P and the driving roller 5 comes into contact with a surface 17 opposite to the recording surface 16 of the recording medium P.

A head portion 12 is provided on a side facing the platen 3 and on a downstream side of the transporting roller portion 18 in the transporting direction A of the recording medium P. The recording apparatus 1 forms a desired image in such a manner that the recording apparatus 1 causes ink to be discharged onto the recording medium P through an ink discharge surface F of the head portion 12, in a state where the head portion 12 is reciprocated, by a carriage 11, in a direction B intersecting with the transporting direction A.

The recording apparatus 1 of this example has the head portion 12 which reciprocates and performs recording. However, the recording apparatus 1 may be a recording apparatus which includes a so-called line head in which a plurality of nozzles through which the ink is discharged are aligned in a direction intersecting with the transporting direction A.

Here, the "line head" means a head portion in which an area of the nozzles formed in an intersecting direction intersecting with the transporting direction A of the recording medium P can cover the entirety of the recording medium P in the intersecting direction and which is used for a recording apparatus which forms an image in such a manner that one of the head portion or the recording medium is fixed and the other one is moved. The area of the nozzles of the line head in the intersecting direction may not cover the entirety of all types of the recording mediums P, which are used in the recording apparatus, in the intersecting direction.

In the recording apparatus 1 of this example, a blower 9 is provided, in the transporting direction A of the recording medium P, on a downstream side of the transporting roller portion 18 and on an upstream side of the head portion 12. The blower 9 blows air, in a direction D, to a recording surface 16 side of the recording medium P transported by the transporting roller portion 18 and to a blown position 13 positioned between the transporting roller portion 18 and the head portion 12. In addition, the blower 9 extends in the direction B intersecting with the transporting direction A of the recording medium P. The blower 9 can blow air over the entirety of the recording medium P in a width direction. The blower 9 has a configuration in which air is taken in from the outside of the recording apparatus 1 such that ink mist in the recording apparatus 1 is not taken in.

In the recording apparatus 1 of this example, an ion generator 10 is provided, in a portion between the blower 9 and the blown position 13, in an air blowing path by the blower 9, which extends in the direction D. In the recording apparatus 1 of this example, the ion generator 10 is installed in a state where the ion generator 10 is fixed to a case of the recording apparatus 1. However, an adjusting portion which adjusts a distance between the ion generator 10 and the recording surface 16 of the recording medium P may be provided, and thus the ion generator 10 may be movable with respect to the recording surface 16 of the recording medium P. As a result, ions generated in the ion generator 10 can effectively reach the recording medium P, in such a manner that the distance is adjusted.

When the configuration of the recording apparatus 1 of this example is described using another expression, the description is as follows. The recording apparatus 1 of this example has the setting portion 14 for setting the recording medium P. In addition, the head portion 12 which discharges ink onto the recording medium P is provided. The transporting roller portion 18 which transports the recording medium P is provided, in the transporting path of the recording medium P, in a portion between the setting portion 14 and the head portion 12. The blower 9 which blows air to the recording surface 16 side of the recording medium P transported by the transporting roller portion 18 and to a portion between the transporting roller portion 18 and the head portion 12 is provided. The ion generator 10 is provided, in the air blowing path of air blown by the blower 9, in a portion between the blower 9 and the recording surface 16 side of the recording medium P.

Therefore, the recording apparatus 1 of this example can cause the ions generated in the ion generator 10 to effectively reach the recording medium P, using the blower 9. In addition, the ion generator 10 is provided in the air blowing path, and thus it is possible to prevent adhesion of the ink mist in such a manner that the ink mist which floats in accordance with a recording operation of the head portion 12 is sent in a direction in which the ink mist moves away from the ion generator 10, by an air flow blown by the blower 9. As a result, it is possible to effectively prevent peeling electrification generated by the transporting roller portion for transporting the recording medium, without frequently replacing parts.

In the recording apparatus 1 of this example, the air blowing path of air blown by the blower 9 further extends, along the recording surface 16 of the recording medium P, from a portion between the transporting roller portion 18 and head portion 12, in a direction E which is the same direction as the transporting direction A of the recording medium P. In other words, the air blowing path extends to an area of the recording medium P on which the head portion 12 performs recording.

Therefore, in the recording apparatus 1 of this example, the ink is dried in such a manner that volatile components in the ink which is discharged onto a recording medium are volatilized by the air flow blown by the blower 9. In addition, the volatile components are sent in the direction in which the volatile components move away from the head portion 12, and thus condensation of the volatile components is prevented in the head portion 12. Furthermore, the heaters are disposed in the platen 3, and thus it is also effective to a configuration in which the ink is dried by heating the recording medium P from the back surface side.

In the recording apparatus 1 of this example, a transporting roller portion 19 is provided, in the transporting direction A of the recording medium P, in a portion between the platen 3 and the platen 4. The transporting roller portion 19 is a pair of transporting rollers constituted by a driving roller 6 which rotates in the rotation direction C and a driven roller 8. When the transporting roller portion 19 transports the recording medium P, the driven roller 8 comes into contact with the recording surface 16 of the recording medium P and the driving roller 6 comes into contact with the surface 17 opposite to the recording surface 16 of the recording medium P.

A general fan can be used as the blower 9. A preferred wind speed for the blower 9 is set to be in a range between 1 [m/sec] and 4 [m/sec]. In addition, it is preferable that a distance between the blower 9 and the recording surface 16 of the recording medium P be set in a range between the 5 cm and 30 cm. The reason for this is to prevent undesirable effects from occurring on ink landing, due to the blown air which becomes turbulent in the vicinity of the recording surface 16.

An electric discharge type or a photoionization type can be preferably used as the ion generator 10. It is possible to use a configuration in which, for example, a structure (manufactured by Sharp Corporation, and the like) in which one electrode generates both a +ion and a −ion, a structure (manufactured by Hamamatsu Photonics K.K., and the like) in which both a +ion and a −ion are generated by a photoionization method, and a structure (manufactured by Murata Manufacturing Co., Ltd. and the like) in which a +ion and a −ion are generated from electrodes are used in combination.

Next, an electric configuration of the recording apparatus 1 of this example will be described.

FIG. 2 is a block diagram of the recording apparatus 1 according to this example of the invention.

A CPU 21 is provided in the controller 20 to control the entirety of the recording apparatus 1. The CPU 21 is connected, through the system bus 22, to both a ROM 23 and a RAM 24. Various control programs executed by the CPU 21, a maintenance sequence information, and the like are stored in the ROM 23. The RAM 24 can temporarily store data.

The CPU 21 is connected, through the system bus 22, to a head driving portion 25 for driving the head portion 12.

The CPU 21 is connected, through the system bus 22, to a motor driving portion 26. The motor driving portion 26 is used for driving a carriage motor 27 for moving the carriage 11, a feeding motor 28 as a driving source of the setting portion 14, a transporting motor 29 as a driving source of the driving roller 5, a transporting motor 30 as a driving source of the driving roller 6, and a winding motor 31 as a driving source of the winding portion 15.

The CPU 21 is connected, through the system bus 22, to a blower driving portion 32 for driving the blower 9.

In addition, the CPU 21 is connected, through the system bus 22, to the ion generator driving portion 33 for driving the ion generator 10.

Furthermore, the CPU 21 is connected, through the system bus 22, to an input/output portion 34 which is connected to a PC 35 which is an external device and inputs recording data or the like to the recording apparatus 1.

Example 2

FIG. 3

Next, details of a recording apparatus of Example 2 will be described with reference to the accompanying drawings.

Figure 3:
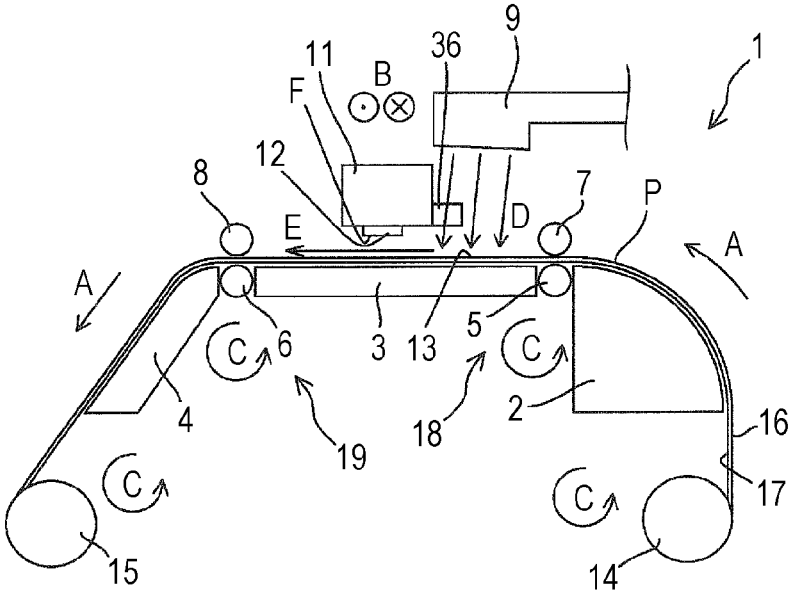
FIG. 3 is a schematic side view illustrating a recording apparatus according to Example 2 of the invention.

FIG. 3 is a schematic side view illustrating a recording apparatus 1 according to this example. The same reference numerals are given to components having the same configurations as those in the example described above and description thereof will not be repeated.

The recording apparatus 1 of this example has the same configuration as that of the recording apparatus 1 of the Example 1, except that the ion generator 36 is mounted on the carriage 11 in a fixed manner, instead of fixing the ion generator 10 to the case of the recording apparatus 1.

In the recording apparatus 1 of this example, an ion generator 36 which reciprocates in a state where the ion generator 36 is mounted on the carriage 11 is provided in a portion between the blower 9 and the blown position 13, in the air blowing path by the blower 9, which extends in the direction D, as illustrated in FIG. 3.

Similarly to the recording apparatus 1 of the Example 1, the blower 9 extends in the direction B and can blow air over the entirety of the recording medium P in the width direction. Therefore, even when the ion generator 36 reciprocates in accordance with reciprocation of the carriage 11 and is located at any position, the ion generator 36 is positioned in a portion between the blower 9 and blown position 13, in the air blowing path by the blower 9, which extends in the direction D.

When the configuration of the recording apparatus 1 of this example is described using another expression, the description is as follows. The carriage 11 which reciprocates in a direction intersecting with the transporting direction A of the recording medium P in a state where the head portion 12 is mounted on the carriage 11 is provided. The ion generator 36 is mounted on the carriage 11.

In other words, in the recording apparatus 1 of this example, a distance between the ion generator 36 and the head portion 12 is short and it is possible to neutralize the recording medium immediately before the head portion 12 performs recording on the recording medium P. As a result, it is possible to more effectively prevent peeling electrification generated by the transporting roller portion for transporting the recording medium P.

Example 3

FIG. 4

Next, details of a recording apparatus of Example 3 will be described with reference to the accompanying drawings.

Figure 4:
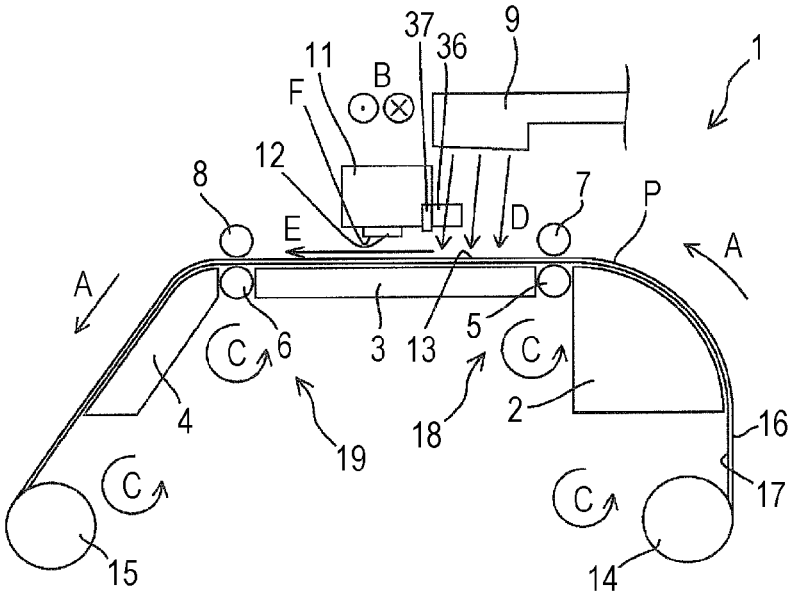
FIG. 4 is a schematic side view illustrating a recording apparatus according to Example 3 of the invention.

FIG. 4 is a schematic side view illustrating a recording apparatus 1 according to this example. The same reference numerals are given to components having the same configurations as those in the example described above and description thereof will not be repeated.

The recording apparatus 1 of this example has the same configuration as that of the recording apparatus 1 of the Example 2, except that an adjusting portion 37 for adjusting a vertical position of the ion generator 36 is provided, and thus a distance between the ion generator 36 and the recording surface 16 of the recording medium P can be adjusted.

The recording apparatus 1 of this example includes the adjusting portion 37 for adjusting the distance between the ion generator 36 and the recording surface 16 of the recording medium P. A plurality of installation positions for the ion generator 36 are formed on the adjusting portion 37 of this example. The distance between the ion generator 36 and the recording surface 16 can be adjusted in such a manner that a user manually installs the ion generator 36 in a different installation position. However, the configuration is not limited thereto. For example, the controller 20 may input, through the PC 35, information on the distance between the ion generator 36 and the recording surface 16 and the ion generator 36 may be automatically moved in accordance with the input value.

When the configuration of the recording apparatus 1 of this example is described using another expression, the description is as follows. The adjusting portion 37 for adjusting the distance between the ion generator 36 and the recording surface 16 of the recording medium P is provided.

Therefore, the recording apparatus 1 of this example can cause the ions generated in the ion generator 36 to effectively reach the recording medium P by adjusting the distance. In addition, the adjusting portion 37 shortens the distance between the ion generator 36 and the recording surface 16 of the recording medium P, for example, and thus the ion generator 36 functions as a wall. As a result, the influence of the air flow which is blown, in the direction E, under the head portion 12 can be prevented. Therefore, it is possible to prevent a landing position of the ink discharged through the head portion 12 from being shifted by the influence of the air flow.

When the descriptions of the recording apparatuses 1 of the Examples 1 to 3 are summarized, the description is as follows. Each of the recording apparatuses 1 of the Examples 1 to 3 includes the blower 9 which blows air to the recording surface 16 of the recording medium P before recording is performed on the recording medium P, and the ion generator 10 or 36 which is provided in the air blowing path by the blower 9.

Accordingly, the blower 9 can cause the ions generated in the ion generator 10 or 36 to effectively reach the recording medium P. In addition, the ion generator 10 or 36 is provided in the air blowing path, and thus adhesion of the floating ink mist is prevented. As a result, it is possible to effectively prevent peeling electrification generated by the transporting roller portion for transporting the recording medium P, without frequently replacing parts.

Next, arrangement examples of ion generators will be described.

Figure 5A:
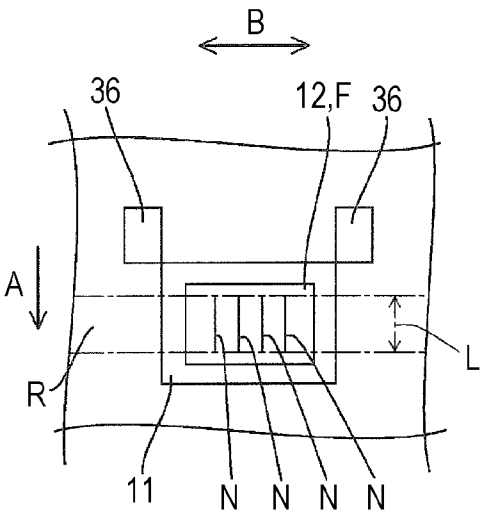
FIGS. 5A to 5C are schematic bottom views illustrating arrangement examples of ion generators.
Figure 5B:
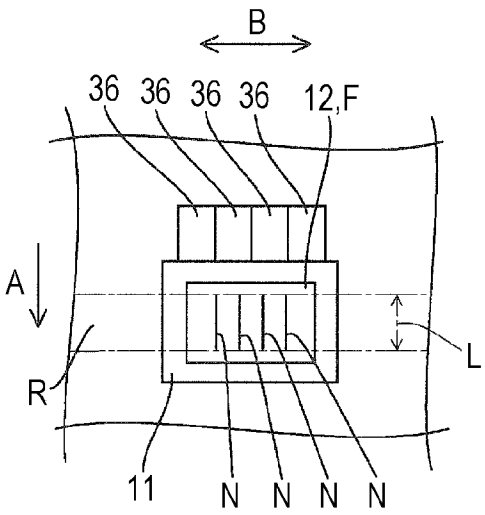
Figure 5C:
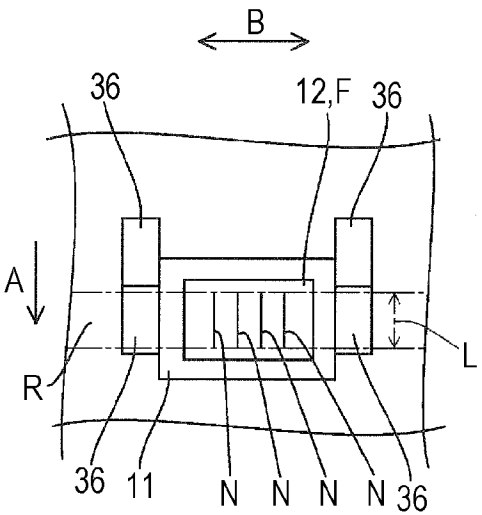

FIGS. 5A to 5C are schematic bottom views illustrating the arrangement examples of the ion generators.

FIG. 5A is the arrangement example of the ion generators, in which the ion generators 36 are arranged on an upstream side of the carriage 11 in the transporting direction A and on both end portions of the carriage 11 in the direction B intersecting with the transporting direction A.

Positions of the ion generators 36 in the transporting direction A are located further on an upstream side than a position of a recording area R which corresponds to a length L of a nozzle row N, which is provided in the head portion 12 and through which the ink is discharged, in the transporting direction A. Thus, even when a movement speed of the carriage 11 in the direction B is increased to increase a recording speed, it is possible to lengthen a period in which the ions generated in the ion generator 36 are sent to the recording area R.

FIG. 5B is the arrangement example of the ion generators, in which a plurality of the ion generators 36 are aligned, in the direction B, on the upstream side of the carriage 11 in the transporting direction A.

Similarly to the arrangement example of FIG. 5A, in the arrangement example of FIG. 5B, the ion generators 36 are provided, in the transporting direction A, further on the upstream side than the position of the recording area R. Therefore, even when the movement speed of the carriage 11 in the direction B is increased to increase the recording speed, it is possible to lengthen a period in which the ions generated in the ion generator 36 are sent to the recording area R.

In the arrangement example of FIG. 5B, four ion generators 36 are aligned in the direction B intersecting with the transporting direction A, and thus the recording medium P is prevented from partially receiving an inadequate amount of ions, due to an influence of the uneven amount of air blown by the blower 9.

In the arrangement example of FIG. 5B, four ion generators 36 are aligned in the direction B intersecting with the transporting direction A. However, the number of the ion generators 36 may be three or less or five or more.

FIG. 5C is the arrangement example of the ion generators, in which the ion generators 36 are provided, on an upstream side of the carriage 11 in the transporting direction A and on both end portions of the carriage 11 in the direction B and are additionally provided, on both end portions of the carriage 11 in the direction B, and in positions facing the recording area R.

Similarly to the arrangement examples of FIGS. 5A and 5B, in the arrangement example of FIG. 5C, the ion generators 36 are provided, in the transporting direction A, further on the upstream side than the position of the recording area R. Therefore, even when the movement speed of the carriage 11 in the direction B is increased to increase a recording speed, it is possible to lengthen a period in which the ions generated in the ion generators 36 are sent to the recording area R.

In addition, in the arrangement example of FIG. 5C, the ion generators 36 are also disposed in positions facing the recording area R, and thus it is possible to send the ions to the recording area R until immediately before recording is performed on the recording area R.

The arrangement example of the ion generators is not limited to the arrangement examples of FIGS. 5A to 5C. Also, the arrangement examples of FIGS. 5A to 5C may be used in combination.

The entire disclosure of Japanese Patent Application No. 2013-193895, filed Sep. 19, 2013 is expressly incorporated by reference herein.

What is claimed is:

1. A recording apparatus comprising:

a setting portion in which a recording medium is set;

a head portion which discharges ink onto the recording medium;

a transporting roller portion which is provided at a portion between the setting portion and the head portion in a transporting path of the recording medium and transports the recording medium;

a blower which blows air to a recording surface side of the recording medium transported by the transporting roller portion and to a portion between the transporting roller portion and the head portion; and an ion generator which is provided at a portion between the blower and the recording surface side of the recording medium, in an air blowing path of air blown by the blower, wherein the distance between the blower and the recording surface is between 5 cm and 30 cm.

2. The recording apparatus according to claim 1, wherein the air blowing path of air blown by the blower further extends, from a portion between the transporting roller portion and the head portion, in a transporting direction of the recording medium, along the recording surface of the recording medium.

3. The recording apparatus according to claim 1, further comprising:

a carriage which reciprocates in a direction intersecting with the transporting direction of the recording medium, in a state where the head portion is mounted on the carriage, wherein the ion generator is mounted on the carriage.

4. The recording apparatus according to claim 1, further comprising:

an adjusting portion which adjusts a distance between the ion generator and the recording surface of the recording medium.

5. A recording apparatus comprising:

a setting portion in which a recording medium is set;

a head portion which discharges ink onto the recording medium;

a transporting roller portion which is provided at a portion between the setting portion and the head portion in a transporting path of the recording medium and transports the recording medium;

a blower which blows air to a recording surface side of the recording medium transported by the transporting roller portion and to a portion between the transporting roller portion and the head portion;

an ion generator which is provided at a portion between the blower and the recording surface side of the recording medium, in an air blowing path of air blown by the blower; and an adjusting portion which adjusts a distance between the ion generator and the recording surface of the recording medium.

* * * * *